US005139873A

United States Patent [19]

Rebouillat

[11] Patent Number: 5,139,873

[45] Date of Patent: Aug. 18, 1992

[54] HIGHLY PROCESSABLE AROMATIC POLYAMIDE FIBERS, THEIR PRODUCTION AND USE

[75] Inventor: Serge Rebouillat, Midlothian, Va.

[73] Assignee: E. I. Du Pont de Nemours and Company, Wilmington, Del.

[21] Appl. No.: 575,543

[22] Filed: Aug. 30, 1990

[30] Foreign Application Priority Data

Sep. 5, 1989 [DE] Fed. Rep. of Germany ..... 3929376

[51] Int. Cl.[5] ..... D06M 13/10

[52] U.S. Cl. ..... 428/375; 8/115.6; 252/8.6; 428/378; 428/395; 428/911

[58] Field of Search ..... 428/375, 378, 395, 911, 428/115.6, 115.51; 252/8.6; 560/205, 265

[56] References Cited

U.S. PATENT DOCUMENTS

| | | | |
|---|---|---|---|
| 3,113,369 | 12/1963 | Barrett et al. | 428/395 X |
| 3,287,324 | 11/1966 | Sweeny | 260/78 |
| 3,859,122 | 1/1975 | Burks, Jr. et al. | 252/8.9 |
| 3,869,429 | 3/1975 | Blades | 260/78 S |
| 3,997,450 | 12/1976 | Steinmiller | 252/8.7 |
| 4,038,258 | 7/1977 | Singh et al. | 428/395 X |
| 4,115,621 | 9/1978 | Hawkins | 428/395 |
| 4,179,544 | 12/1979 | Newkirk et al. | 428/395 |
| 4,291,093 | 9/1981 | Wishman et al. | 428/379 |
| 4,455,341 | 6/1984 | Harteman | 428/225 |
| 4,606,972 | 8/1986 | Marshall | 428/395 |
| 4,613,535 | 9/1986 | Harpell et al. | 428/113 |
| 4,670,343 | 6/1987 | Makino | 428/395 |
| 4,883,604 | 11/1989 | Veitenhansl et al. | 252/8.9 |
| 4,929,504 | 5/1990 | Veitenhansl et al. | 428/395 |
| 4,957,648 | 9/1990 | Yodice et al. | 252/2.6 |

FOREIGN PATENT DOCUMENTS

| | | |
|---|---|---|
| 107887 | 5/1984 | European Pat. Off. . |
| 136727 | 8/1987 | European Pat. Off. . |
| 239915 | 10/1987 | European Pat. Off. . |

OTHER PUBLICATIONS

Research Disclosure, May 1978, No. 169, disc. 16949.
Research Disclosure, Jul. 1980 disc. 19520.

*Primary Examiner*—George F. Lesmes
*Assistant Examiner*—Christopher Brown

[57] ABSTRACT

The invention relates to highly processable aromatic polyamide fibers of high modulus, improved surface frictional properties, improved scourability, low abrasion depositing, low fibrillation and improved longterm antistatic properties having a coating of a lubricant, an emulsifying system, and an antistatic agent, and a process for making such fibers.

18 Claims, No Drawings

HIGHLY PROCESSABLE AROMATIC POLYAMIDE FIBERS, THEIR PRODUCTION AND USE

BACKGROUND OF THE INVENTION

1. Field of the Invention

The present invention relates to highly processable aromatic polyamide fibers, their production and use.

Due to recent demands, various novel high strength, high modulus fibers, such as aromatic polyamide (aramid) materials, have been proposed to reinforce elastomeric and plastic materials.

2. Description of the Prior Art

U.S. Pat. No. 3,869,429 and its German equivalent DE 22 19 703 as well as U.S. Pat. No. 3,287,324 describe aromatic polyamides and wholly aromatic polyamides useful for making fibers and films for various applications.

U.S. Pat. No. 4,670,343 is related to a wholly aromatic polyamide fiber which has improved surface frictional characteristics, especially to a wholly aromatic fiber which exhibits a reduced filament-to-filament friction, low breakage and fibrillation and a high strength, which is used in a twisted form as a reinforcing cord for rubber or composite materials. The fiber is coated with at least 0.05% by weight of a reaction product, of a polyoxyethylene adduct of glyceride having at least one hydroxyl group in the molecule with a dibasic acid and/or a dibasic anhydride. The fiber itself is cured and drawn at 500° C.

EP 0 107 887 relates to a multi-filament yarn which entirely or substantially consists of an aromatic polyamide which is provided with an adhesive coating of a cured epoxy compound. The epoxy compound having an average of 2 to 4 epoxy groups per molecule is applied to the yarn as an aqueous solution or dispersion. After being taken up by the yarn, the epoxy compound is cured at temperatures between 220° C. and 230° C. which results in the formation of a coating being present on the yarn in between 0.01 and 5% by weight. The epoxy compound, curing agent and catalyst containing solution may be applied to the freshly spun wet filament or to the dried filament.

EP 0 136 727 describes the preparation of an aromatic polyamide filament yarn which is impregnated with solid particles of a fluorine containing polymer (PTFE) and/or graphite from an aqueous dispersion. The yarn is then subjected to a blowing treatment while in the wet state.

EP 0 239 915 is related to a process for producing a modified fibrous material from aromatic polyamide fibers by applying a cold plasma treatment under reduced pressure to the surface of the fiber in order to achieve an enhancement of the bonding property of the fiber to rubber. To this fiber an ion-plating treatment with a polyamide vapor is applied under reduced pressure. After impregnating the fiber with an adhesive composition, the product is then dried and cured at elevated pressure.

In the state of the art of the above mentioned last 4 references a resin is applied to the fiber as impregnating agent in order to facilitate the reinforcement of rubber articles and other materials. After the application a curing step is always necessary in which the surface reacts with the resin.

Another reference (Research Disclosure, May 1978, No. 169, disclosure 16949) discloses finishes useful for treating industrial fibers, such as polyamide and copolyamide yarns, for tire cords which contain ingredients selected from (a) natural or synthetic lubricant such as cocunut oil, palm oil, pentaerythritol tetrapelargonate or ditridecyl adipate, (b) a nonionic emulsifier with a hydrophiliclipophilic balance (HLB) of 11-14, such as PEG (400-600) monostearate or mono-oleate, polyoxyethylene (30) sorbitol tetraoleat-monolaurate or polyoxyethylene (4) sorbitan monolaurate, (c) a nonionic emulsifier with an HLB of 7-10, such as PEG (400) distearate or dioleate, polyoxyethylene (3) sorbinate monostearate, polyoxyethylene (40) septaoleate or polyoxyethylene (5) stearic acid, (d) an antioxidant, such as tris-nonylphenyl phosphite, 4,4'-butylidene-bis-(6-t-butyl-m-cresol), tetra bis [methylene-3-(3',5'-di-t-butyl-4-hyrdoxy-phenyl)propionate]methane, or the product derived from condensation of butylated p-cresol and dicyclopentadiene, (e) a substituted polysiloxane, such as dimethyl, diphenyl, methylethyl or methyl-phenyl polysiloxane, and (f) a sulfonated natural oil, such as peanut or palm oil.

One preferred composition contains 60-70 parts (a), 15-25 parts (b), 5-15 parts (c) and 1-5 parts (d). Another contains 60-70 parts (a), 15-25 parts (b), 5-15 parts (c), 2-10 parts (d) and 1-7 parts (e). Another contains 55-65 parts (a), 15-25 parts (b), 5-15 parts (c), 1-5 parts (d), and 5-15 parts (f). Another contains 55-65 parts (a), 15-25 parts (b), 5-15 parts (c), 2-10 parts (d) 1-5 parts (e) and 5-15 parts (f). A still other reference (Research Disclosure, Jul. 1980, No. 195, disclosure 19520) discloses finishes useful for treating industrial fibers, such as polyamide and aramid fibers, which contain ingredients selected from (a) natural or synthetic esters such as coconut oil, palm oil, pentaerythritol tetrapelargonate, ditridecyl adipate, or an interesterified combination of glycerol trioleate, coconut oil, and palm oil or tridecyl oleate, (b) products derived by reacting a fatty acid or acids with an adduct of ethylene oxide and a polyol or with a polyethylene glycol compound such as polyoxyethylene (2-10) sorbitan monolaurate, polyoxyethylene (20-50) sorbitol septaoleate, polyoxyethylene (20-40) sorbitol tetraoleatemonolaurate, polyethylene glycol (400-600) monostearate or monolaurate or polyethylene glycol (400-600) dilaurate, (c) an ethoxylated glyceride obtained from the reaction of 1 mole of castor oil, hydrogenated castor oil, or coconut oil with 10-50 moles of ethylene oxide, (d) tris(nonylphenyl)phosphite, 4,4'-butylidene-bis(3-methyl-6-tert butylphenol), or 4,4'-thio-bis(3-methyl-6-tert butyl-phenol) and (e) a biostat such as o-phenylphenol or the sodium or potassium salt of 2-pyridinethiol-1-oxide.

One preferred composition contains 60-70 parts (a), 20-40 parts (b), up to 5 parts (d), up to 5 parts (e), and up to 5 parts water. A second preferred composition contains 45-55 parts (a), 20-30 parts (b), 20-30 parts (c), up to 5 parts (d), up to 5 parts (e), and up to 5 parts water. When polyamide or aramid fibers bearing any of the above finishes are crimped, a compound from the group of i) polyoxyethylene (20-40) sorbitan monostearate, ii) polyoxytheylene (15-30) sorbitan tristearate, iii) polyoxyethylene (15-30) sorbitan monooleate, or iv) the potassium or sodium of the product of the reaction of 1 mole of phosphorus pentoxide and 2-3 moles of a fatty alcohol such as lauryl alcohol, hexadecyl alcohol, or stearyl alcohol is advantageously applied at the crimper. Staple prepared from the fibers treated as described above is advantageously treated with IV), above, after crimping and prior to further processing.

In the two last cited references, finishes are disclosed which contain a lubricant, comprised of esters composed of an aliphatic, saturated carboxylic acid and a polyhydric or aliphatic unbranched alcohol. These finishes also contain an emulsifier or emulsifying system, an antioxidant to increase the stability of the composition, polysiloxanes as further thermostable lubricant, a sulfated natural oil as antistatic agent which is, however, not hydrolysis-stable. Furthermore, these finished may contain biostats, further emulsifiers or lubricants.

However, the finishes according to these references are not suitable for the purposes of the present invention in terms of surface frictional properties, scourability, depositing due to abrasion, fibrillation and antistatic properties of the resulting treated fibers.

Most of the commercial products have a high rigidity, poor surface functional characteristics leading to fibrillation, mainly caused by friction among filaments, and poor surface affinity for most traditional elastomeric, thermoplastic and thermoset matrices which they reinforce.

SUMMARY OF THE INVENTION

In order to overcome part of these problems these fibers are used, for example, as reinforcement in tires, belts or hoses, in a twisted form. This does not always mean that this technique enables a 100% strength conversion. These drawbacks and defects, which result in a degradation of physical properties such as strength and modulus, have consequently been driving a high demand for highly processable fibers which have to be easy to process through knitting or weaving operation and do not lead to machine deposits.

One object of the present invention is to provide an aromatic polyamide fibrous material, useful for reinforcing rubber articles, for the production of ballistic fabric and other materials which involve in their production a twisting, knitting, braiding, spiralling or weaving operation, having improved surface frictional properties (fiber/metal) over a broad range of operating speed, an excellent processability in terms of deposition and fibrillation, very good antistatic properties even at low humidity level and very good wash-off properties as well as inert behavior of this fiber surface towards polymers and high shear strength properties.

A further object of this invention is to provide continuous (on-line) and batch-wise (off-line) processes for producing the modified aromatic polyamide fibrous material. Another object of this invention is to provide a highly processable aramid element (yarn, thread, cord) usable for ballistic fabric production or as a reinforcing element for elastomeric composite. The improved processability of this product leads to higher performance of the final system (for example higher strength conversion in fabric and higher ballistic performance).

Another object of the invention is to provide aramid fibers which can be used without twisting in production lines which involve, for example, a knitting or weaving operation of a single yarn. When used in a twisted form, for example in a cord, the tenacity and modulus of the aramid element is better utilized in the final cord structure than with commercially available products.

A still other object of the present invention is to provide bullet and fragment resistant apparel having improved properties.

According to this invention, the application of certain surface treatment agents (NPP; New Processability Promoter) on the surface of aramid fibers using either the standard finishing process known in the art or the application on the never drawn never dried fiber using a process similar to the activation process known in the art is offering a new surface treated fiber which exhibits excellent processability characteristics in its application as a reinforcing element for rubber applications or as a yarn for ballistic fabric woven structures. The end use performance of the final system is consequently significantly improved.

DETAILED DESCRIPTION OF THE INVENTION

The present invention relates accordingly to highly processable aromatic polyamide fibers of high modulus, improved surface frictional properties, scourability, depositing, fibrillation and antistatic properties having a coating, characterized in that said coating consists of (a) 30 to 70% by weight of a low viscosity esteroil lubricant, consisting of an ester, composed of i) an alcohol component which is a branched, primary or secondary, saturated monohydric alcohol of the general formula $$CH_3-(CH_2)_h-\overset{\overset{R^1}{|}}{(CH)_k}-(CH_2)_l-\overset{\overset{R^2}{|}}{CH}-(CH_2)_m-OH$$

wherein $R^1$ represents $C_1$-$C_{16}$-alkyl, $R_2$ represents H, $C_1$-$C_{16}$-alkyl, h=0-5 k=0 or 1 l=0-4 m=0-16 and wherein the total number of carbon atoms is below 25, and ii) a carboxylic acid component which is an unsaturated fatty acid of the general formula $$R^3-COOH$$

wherein $R^3$ represents $C_4$-$C_{19}$-alkenyl, $C_4$-$C_{19}$-alkadienyl, $C_4$-$C_{19}$-alkatrienyl, phenyl, naphthyl, 2-phenylethenyl, or which is an unsaturated dicarboxylic acid of the general formula $$HOOC-(CH=CH)_n-COOH$$

wherein n=1 or 2 and said ester has a solidification point of below +5° C., preferably below 0° C., a kinematic viscosity of below 70 $mm^2$/sec, preferably below 50 $mm^2$/sec (at 20° C.) and an iodine value between 30 and 140, preferably between 30 and 80.

(b) 20 to 50% by weight of an emulsifying system which consists of unsaturated ethoxylated fatty acids and/or unsaturated ethoxylated fatty alcohols and/or ethyoxylated alkylamines of the general formula $R^4—X—(EO)_p(PO)_q—OH$ wherein $R^4$ represents $C_5$–$C_{20}$-alkenyl, phenyl, naphthyl, or $C_8$- or $C_9$-alkylphenyl, X represents —COO—, —NH— or —O—, EO represents ethylene oxide units, PO represents propylene oxide units, p=2 to 15 and q=0 to 10, (c) 5 to 15% by weight of an antistatic agent, consisting of alkali salts of $C_4$–$C_{12}$-alkyl sulfonates or $C_4$–$C_{12}$-alkyl phosphates, (d) 0.2 to 2% by weight of a corrosion-inhibitor, and (e) optionally additives and whereby the amount of said coating on said fiber is between 0.05 and 2.0% by weight, preferably 0.2 to 1.0% by weight.

The coating preferably consists of 50 to 60% by weight, most preferably 55 to 60% by weight of the low viscosity esteroil (a), 25 to 40% by weight, most preferably 29 to 35% by weight of the emulsifying system (b), 5 to 10% by weight, most preferably 5 to 7% by weight of the antistatic agent (c), 0.3 to 1% by weight, most preferably 0.3 to 0.5% by weight of the corrosion inhibitor (d) and, if desired, optionally additives (e).

The invention is further directed to fibers consisting of highly processable polyamide fibers of high modulus, improved surface frictional properties, improved scourability, low abrasion depositing, low fibrillation and improved long term antistatic properties having a coating obtainable by treatment of said fibers with a surface treatment agent containing a lubricant, an emulsifying system, an antistatic agent and other components, characterized in that said surface treatment agent consists of (a) 30 to 70% by weight of a low viscosity esteroil lubricant, (b) 20 to 50% by weight of an emulsifying system, (c) 5 to 15% by weight of an antistatic agent, (d) 0.2 to 2% by weight of a corrosion-inhibitor, (e) optionally additives the amount of said coating being between 0.05 and 2.0% by weight, preferably 0.2 to 1.0% by weight.

The surface treatment agent preferably consists of 50 to 60% by weight, most preferably 55 to 60% by weight of the low viscosity esteroil (a), 25 to 40% by weight, most preferably 29 to 35% by weight of the emulsifying system (b), 5 to 10% by weight, most preferably 5 to 7% by weight of an antistatic agent (c), 0.3 to 1% by weight, most preferably 0.3 to 0.5% by weight of the corrosion inhibitor (d) and, if desired, optionally water and optionally additives (e).

The highly processable aromatic fibers according to the invention are further characterized by a specific breaking strength of 2.65 to 33.5 cN/dtex (3 to 38 g/den), a specific modulus of 8.83 to 2207 cN/dtex (10 to 2500 g/den), a finish on yarn level of 0.05 to 2% by weight, a fiber to metal dynamic friction coefficient on a 1100 dtex aramid yarn of lower than 0.55, preferably below 0.50 at 200 m/min, a fiber of metal boundary friction coefficient on a 1100 dtex aramid yarn of lower than 0.10, preferably below 0.05 at 0.16 cm/sec, and amount of deposit due to abrasion of lower than 0.5 mg/kg of yarn, a residual finish level of lower than 25% by weight of the initial finish level of the washing.

Within the scope of the invention, by fibers are understood continuous filaments as well as a single yarn or cord, staple fibers, fiber tows (for example for stretched breaking processes), yarns or flat textile skeins, staple crimped fibers, pulps, industrial woven, twisted, knitted, braided, spiralled or wrapped textile from aromatic polyamides with fiber type structure.

Aromatic polyamides are such polymers that are partially, preponderantly or exclusively composed of aromatic rings, which are connected through carbamide bridges or optionally, in addition also through other bridging structures. The structure of such aromatic polyamides can be elucidated by the following general formula of repeating units:

$(—CO—NH—A_1—NH—CO—A_2—CO)n$ in which $A_1$ and $A_2$ are the same or different and signify aromatic and/or polyaromatic and/or heteroaromatic rings, that can also be substituted. Typically $A_1$ and $A_2$ may independently from each other be selected from 1,4-phenylene, 1,3-phenylene, 1,2-phenylene, 4,4'-biphenylene, 2,6-naphthylene, 1,5-naphthylene, 1,4-naphthylene, phenoxyphenyl-4,4'-diylene, phenoxyphenyl-3,4'-diylene, 2,5-pyridylene and 2,6-quinolylene which may comprise halogen, $C_1$–$C_4$-alkyl, phenyl, carboalkoxyl, $C_1$–$C_4$-alkoxyl, acyloxy, nitro, dialkylamino, thioalkyl, carboxyl and sulfonyl. The —CONH-group may also be replaced by a carbonyl-hydrazide (—CONHNH—) group, azo-or azoxy-group.

Further useful polyamides are disclosed in U.S. Pat. No. 4,670,343 wherein the aromatic polyamide is a copolyamide in which preferably at least 80% by mole of the total $A_1$ and $A_2$ are 1,4-phenylene and phenoxyphenyl-3,4'-diylene which may or may not be substituted and the content of phenoxyphenyl-3,4'-diylene is 10% to 40% by mole.

Fibers derived from wholly aromatic polyamides are preferred. Examples of aromatic polyamides are poly-m-phenylene-isophthalamide and poly-p-phenylene-terephthalamide.

Especially suitable are poly-m-phenyleneisophthalamide fibers according to U.S. Pat. No. 3,287,324 and poly-p-phenylene-terephthalamide fibers according to U.S. Pat. No. 3,869,429 and DE 22 19 703.

Further suitable polyamides are those structures in which at least one of the phenyl radicals bears one or more of the above mentioned substituents. Additional aromatic compounds contain, to some extent at least, repeating units that are derived from 3- or 4-aminobenzoic acid, respectively.

Additionally suited for finishing with the surface treatment agent of the invention are wholly aromatic polyamide fiber that have been stretched at a temperature of at least 150° C. according to DE 22 19 646.

Additional suitable aromatic polyamides are of the following structure $(—NH—Ar_1—X—Ar_2—NH—CO—Ar_1—X—Ar_2—CO—)n$ in which X represents O, S, $SO_2$, NR, $N_2$, $CR_2$, CO R represents H, $C_1$–$C_4$-alkyl and $Ar_1$ and $Ar_2$ which may be same or different are selected from 1,2-phenylene, 1,3-phenylene and 1,4-phenylene and in which at least one hydrogen atom may be substituted with halogen and/or $C_1$–$C_4$-alkyl.

One aramid preferably used as a reinforcing element in the examples of the present invention is poly-p-phenylene-terephthalamide. More particularly, poly-p-phenylene-terephthalamide fiber (1500 denier) has been mainly used besides the other fibers yielding the same significant improvement in processability and properties after being treated with the surface treatment agent. In the case of ballistic application the yarn used for the reduction to practice was a 1000 denier aramid fiber.

The NPP formulation comprises a lubricant, an emulsifying system, an antistatic agent and a corrosion inhibitor, and if desired, optionally water and/or optionally additives.

The lubricant (a) is a low viscosity esteroil which is characterized as stated above. Examples for the alcohol compound (I) of the ester can be 2-methyl-1-propanol, 2-butanol, 2-pentanol, 2-methyl-1-butanol, 3-methyl-1-butanol, 3-methyl-2-butanol, 2-methyl-1-pentanol, 4-methyl-1-pentanol, 4-methyl-2-pentanol, 2-pentanol, 3-heptanol, 2-octanol, 2-ethyl-1-hexanol, 3,5-dimethyl-1-hexanol, 5-nonanol, 2-6-dimethyl-4-heptanol, iso-hexadecyl-alcohol or iso-tridecyl alcohol. Examples for the carboxylic acid component (II) can be lauroleic acid, myristoleic acid, palmitoleic acid oleic acid, gadoleic acid, erucic acid, ricinoleic acid, tallow acid, linoleic acid, linolenic acid, fumaric acid, maleic acid, cinnamic acid, naphthaline carboxylic acid or benzoic acid.

The emulsifying system is a nonionic system as defined above. Examples of unsaturated fatty acids are lauroleic acid, myristoleic acid, palmitoleic acid, gadoleic acid, eruicic acid or ricinoleic acid, preferably oleic acid (with 3-15 moles ethylene oxide). Examples of unsaturated fatty alcohol are elaidyl alcohol, erucyl alcohol, brassidyl alcohol, preferably oleyl alcohol and/or tallow alcohol (with 3-10 moles EO). Further examples are $C_8$- or $C_9$-alkylphenolethoxylates, preferably octylphenol- or nonylphenolethoxylates, (5-15 moles EO).

As known to the artisan it is furthermore important to adjust the hydrophilic-lipophilic-balance (HLB)-value to the lubricant in order to obtain a stable emulsion. This is achieved by observation of the emulsion and its stability.

Antistatic compounds are alkali salts, preferably sodium salts of alkyl sulfonates (e.g. lauryl sulfonate; sodium salt), alkyl phosphates like $C_4$–$C_{12}$-alkyl phosphates (mono/diester mixture) and fatty acids salt (sodium salt of oleic acid). Sodium chloride content should be below 0.1%. It is also possible to use alkyl-sulfates, however, they are not preferred because they hydrolyze easily and therefore loose their antistatic efficiency.

Useful corrosion inhibitors are diethanolamine salts of $C_4$–$C_{12}$-alkylphosphate-esters (mono/di) or amine salts of fatty acids or benzoic acid.

The formulation may optionally contain water for stabilization reasons even before it is diluted with water in order to obtain its concentration with which it is applied to the fibers.

The following additives can optionally be incorporated in the formulation if specific properties or process conditions are required, for example adhesion, specific cross-linkage, UV-protection, pigmentation or rheological adjustment. These additives may further comprise fungicides, bacteriocides, and biocides.

In certain applications e.g. elastomer reinforcement or composite structure coupling agents can be used. Examples comprise zirconaluminates derived from zirconium oxychloride ($ZrOCl_2.8H_2O$) and from aluminium chlorohydrate ($Al_2(OH)_5Cl$)(combined for the preparation of the inorganic backbone which is selectively complexed with carboxylic acid derivative (XROCOOH) to form the final product);

amino-silanes with the general structure $$Y(CH_2)_nSiX_3,$$

where n=0 to 3, X is an hydrolysable group based on silicon and Y is an organofunctional group (e.g. vinyl, chloropropyl, glycidoxy, methacrylate, primary amine, diamine, mercapto, cationic styryl etc.) selected for reactivity adjustment. Examples of such silane coupling agents are -aminopropyltriethoxysilane and -mercaptopropyltrimethoxylisane;

titanates with the general formula $$YOTi(OX)_3$$

where Y is an isopropyl group and X is a larger group such as a stearate.

Other examples comprise melamine-methylol-methyl ethers (e.g. hexa-methoxymethyl melamine).

Useful UV-absorbers comprise benzotriazole compounds, antioxidants comprise tris-nonylphenyl phosphite, 4,4'-butylidene-bis-(6-t-butyl-m-cresol), tetra bis[-methylene -3-(3',5'-di-t-butyl-4-hydroxy-phenyl)propionate]methane, or the product derived from condensation of butylated p-cresol and dicyclopentadiene.

The pigments used should be heat stable up to 250° C. and may include conventional as well as fluorescent pigments.

The thus obtainable surface treatment agent is further characterized by a viscosity of lower than 120 $mm^2$/sec, preferably below 85 $mm^2$/sec (at 20° C.), a weight-loss of lower than 25%, preferably after 2 h at 200° C., a surface tension of a 1% emulsion of lower than 35 mN/m, preferably below 32 mN/m at 20° C.

The invention further relates to a process for the production of a highly processable aromatic polyamide fiber coated on the surface treatment agent.

The coating of the aromatic polyamide fibers with the surface treatment agent of the invention can take place in various ways and more specifically according to the three following processes (a), (b) and (c) (Table 1).

Both process (a) and process (b) are continuous (on-line) processes. Continuous or on-line means that the application of the surface treatment agent is accomplished during the usual process of preparing fibers (spinning, drying, drawing and winding up on bobbins).

According to process (a) the application of the surface treatment agent is made on the never-dried never-drawn fiber using either a finish application (e.g. metering system), a roll applicator with or without doctor blade, a serpentine system or any known in the art coating devices. Ultrasonic systems and known in the art devices can also be used in order to enhance the uniformity or penetration of the agent. For the freshly spun and neutralized and/or washed fiber the surface treatment agent is used neat or in a diluted aqueous form, which is in a concentration of as low as 5% by weight of said surface treatment agent in water.

In the preferred route for process (a), the NPP containing about 30% water has been applied (this means 30 parts by weight NPP+70 parts by weight water on a wet aramid fiber. The emulsion treated fiber is then dried during the fiber stretching drying step at a temperature between 150° and 190° C., preferably at 170° C. for few seconds (5-10 s) while the yarn speed was around 630 m/min (workable range 270-675 m/min). The finish level after the drying step was adjusted to be between 0.05 to 2.0% by weight, preferably 0.2 to 1.0% by weight.

According to process (b) the application of the neat surface treatment agent is done according to conventional finishing process known in the art. The application is carried out on the fully dried fiber just before the winding operation. The finish levels are in the range of 0.05 to 2% by weight, preferably 0.2 to 1.0% by weight.

Furthermore, a combination of process (a) and (b) is also feasible. Thus, a never-dried, never-drawn aromatic polyamide fiber may be treated with the aqueous, diluted or neat formulation according to the invention and subsequently dried. That dried fiber may further be treated with the neat surface treatment agent and wound without an additional drying step.

According to process (c) the treatment of the fiber is performed on batch-wise (off-line) dipping or finishing equipment. Batch-wise means that the application of the surface treatment agent is made after the yarn, produced in an independent process, has been wound without being subjected to a surface treatment. In process (c) the previously produced never-dried, never-drawn fiber or the dried fiber, after it has been unwound, for example from a bobbin on which it was provided, is immersed in a bath provided with the surface treatment agent and then dried or not dried depending on whether the agent has been applied neat or in a diluted, aqueous form and whether the fiber needs to be drawn under heating. If the agent has been applied in an aqueous form, the application step has to be followed by drying step, which is carried out at a temperature between 80° to 190° C., preferably between 110° and 130° C. and most preferably at 120° C. This process is especially directed to the application of the NPP-formulation according to the invention to polyamide fibers, preferably aromatic polyamide fibers, which are commercially available, have been stored or are derived from another process and which have not yet been treated.

Drying may be effected by convection (e.g. hot air), heat conduction (e.g. contact-drying), irradiation (e.g. infra-red or microwave). The heat treatment of the treated fiber is usually carried out for a period of from a few seconds to some minutes, depending on the drying degree requirements for further applications.

In the course thereof, the machine speed may be selected from a few meters per minute until several hundred meters per minute, while, as a general rule, also the amount of coating of the fiber of the treatment agent is controlled by means of said machine speed and/or by concentration adjustment.

The application of the surface treatment agent could also be performed after drying the yarn or the cord in the first heated chamber at 80° to 190° C.

Dipping can be performed through several steps with identical or different dip concentrations neat or in concentrations of as low as 5% by weight in water with or without intermediate drying. This is referred to as multiple dipping.

Ultrasonic, electrostatic and plasma treatment of the yarn can be additionally applied before, during or after the impregnation in order to improve the penetration of the agent. Traditional related equipments are suitable for these specific treatments.

In the preferred route of process (c) yarns and cords were passed through the NPP dip of a dipping unit (by Zell-Company) to coat them and then dried in the air heated chamber at 80° to 190° C., preferably at 110° to 130° C. with a predetermined tension of 6 N for an untwisted 1670 dtex yarn. The most preferred temperature for this step is about 120° C. Depending on the dip concentration which may between 5% and 100% by weight in water the speed was adjusted to be between 15 to 35 m/min. The same surface treating agent concentrations and finish levels as process (a) and (b) were used.

If desired, all processes (a), (b), and (c) can be conducted as a multi-step process in which the fiber may be several times immersed in a surface treatment agent and in turn dried. For example the treatment agent can be applied on the never-dried wet fiber, then the fiber can be dried and thereafter the surface treatment agent can be applied once more or even several times more with or without intermediate drying. Alternatively, the treatment agent is applied after the fiber has been dried and after further drying once or several times again with or without intermediate drying.

The following table summarizes the application of different processes.

TABLE 1

| Aramid Fiber | NPP | Drying Step | Finish on Yarn (% by wt.) | Process |
|---|---|---|---|---|
| never-dried never drawn | 100% (neat) or diluted as low as 5% by weight NPP in water | 150-190° C. pref. 170° C. | 0.05-2 pref. 0.8 | (a) continuous |
| dried (80-120° C.) | 100% (neat) | none | 0.05-2 pref. 0.8 | (b) continuous |
| never-dried never drawn | 100% (neat) | none | 0.05-2 pref. 0.8 | $(c)_1$ |
| | — diluted: as low as 5% by wt. NPP in water | — 80-190° C. (110-130° C. pref 120° C.) | — 0.05-2 pref. 0.8 | — $(c)_2$ batch |
| dried (80-120° C.) | 100% (neat) | none | 0.05-2 pref. 0.8 | $(c)_3$ |
| | diluted: as low as 5% by wt. water | 80-190° C. (110-130° C. pref 120° C.) | 0.05-2 pref. 0.8 | $(c)_4$ batch |

A further application of the fibres according to the invention is in the reinforcement of hoses, belts, ropes and cables including optical cables, rubber goods and composite structures (e.g. sporting goods, medical supplies, building and acoustic materials, transport and protective equipment for civil and military applications).

DESCRIPTION OF THE PREFERRED EMBODIMENTS

The following notations were used:

| | |
|---|---|
| NPP: | New Processability Promoter |
| NPPTY: | NPP treated 1000 denier yarn |
| Comp.: | commercial state of the art of the same denier treated with a standard finish |
| TM: | Twist Multiplier<br>TM = 80 T/m (turns per meter) for 1670 dtex |

-continued

| TM = 120 T/m for 1100 dtex |
|---|

TABLE 2

Performance of the Surface Teated Material
Comparison of tenacity in cN/dtex (g/den) of process (a) and (b) products with Comp.

| Process (a) | Comp. | Process (b) |
|---|---|---|
| NPPTY 19.67 (22.1)> | 19.94 (22.4) | |
| | 20.65 (23.2) | <20.74 (23.3) NPPTY |

The main concern of experts in the art of treating never-drawn fibers, in the present case process (a), is the strength retention of the fiber after the treatment. The above table clearly indicates that none of the treatments leads to strength loss. Consequently, it is important to note that the lubrication of a high strength fiber is feasible prior to the annealing-stretching treatment without tenacity loss.

The specific breaking strength (tenacity) of a NPP-treated aromatic polyamide fiber according to the invention lies between 2.65 and 33.5 cN/dtex (3 to 38 g/den), the specific modulus is between 8.83 and 2207 cN/dtex (10 to 2500 g/den), preferably between 26.5 and 1060 cN/dtex (30 to 1200 g/den).

TABLE 3

Compared physical properties

| (1100 dtex Fiber) | | Comp. | NPPTY |
|---|---|---|---|
| 1. FRICTION | | | |
| Fiber/Fiber | (0.016 cm/sec) | 0.22 | 0.21 |
| | (128 cm/sec) | 0.28 | 0.26 |
| Fiber/Metal | (0.016 cm/sec) | 0.12 | 0.04 |
| | (128 cm/sec) | 0.30 | 0.25 |
| | (200 m/min) | 0.70 | 0.52 |
| 2. Deposit (mg/kg) | | 10 | 0.4 |
| 3. Fibrillation Index | | 21 | 2 |
| 4. Scourability (residual finish level) | | 46% | 27% |

In the above Table 3 the NPP treated aramid fiber NPPTY shows superiority, in terms of friction especially dynamic friction F/M (200 m/min), deposit measured in mg/kg of yarn and fibrillation compared to the control aramid fiber (Comp.) which is commercially available.

For the antistatic performance a generally good performance starts at −6 kV, consequently the measured value of −2.5 kV for the NPP treated fiber is excellent in terms of staticity.

The scourability (wash-off property) is also a very important factor since the residual finish level after a washing-step known to the artisan (measured in %) impacts the subsequent finishing operation in the case of fabrics. The scourability values mentioned in Table 3 were obtained on an industrial scale using fabrics made of NPP treated yarn and compared to a control yarn which was a commercial product of the same denier treated with a standard finish. The ratio between NPP and Comp. treated yarns were confirmed in the laboratory on yarns washed two times with warm soft water at 50° C. using 100 ml of water for 10 g of yarn.

Friction coefficients were determined according to the following method: A package of yarn is threaded through a tensioning device, between a guide roll and two strain gauges, and onto a take-up roll driven by a variable speed motor. The two strain gauges record $T_1$ and $T_2$ input and output tension respectively. The coefficient of friction is computed according to the formula:

$$T_1/T_2 = \exp(\alpha f)$$

where $\alpha$ is the friction angle and f the friction coefficient (fiber to fiber, fiber to metal or fiber to ceramic depending on whether a polished chrome or ceramic pin was used). The Rothschild friction meter R-1182 has been used according to the standard procedure known in the art.

The deposit due to abrasion was measured on a "Staff-Tester G 555" (Zweigle, West Germany) with which the weight of the abraded fiber-material arising from fiber to fiber friction was determined.

The fibrillation index was determined on a "G 566" apparatus (Zweigle, West Germany).

Ballistic tests

The ballistic test method for personal armours ($V_{50}$ test) was carried out according to the NATO standardization agreement STANAG 2920.

The $V_{50}$ ballistic limit velocity for a material or armour is defined as that velocity for which the probability of penetration of the chosen projectiles is exactly 0.5, using the Up and Down firing method and calculation described below.

The Up and Down firing method:

The first round shall be loaded with the amount of propellant calculated to give the projectile a velocity equivalent to the estimated $V_{50}$ ballistic limit of the armour. If the first round fired produces a complete penetration, the second round shall be loaded with a fixed decrement of propellant calculated to produce a velocity about 30 m/s lower than the first. If the first round fired results in a partial penetration, the second round shall be loaded with a fixed increment of propellant calculated to produce a velocity about 30 m/s higher than the first round. Upon achieving the first set of penetration reversals, the propellant charge should be adjusted with the fixed amount to yield an increment or decrement of velocity of about 15 m/s. Firing will then continue in accordance with a given procedure to obtain an estimate of the $V_{50}$ BL(P) [Ballistic Limit Protection].

$V_{50}$ calculation:

After a number of projectiles have been fired the $V_{50}$ is calculated as the mean of the velocities recorded for the fair impact the fair impacts consisting of the three highest partial velocities for partial penetration and the three lowest velocities for complete penetration provided that all six velocities fall within a bracket of 40 m/s.

The fabric was made of a 1000 denier fiber.

Usually in the area of high tenacity fiber the weaving operation of ballistic fabrics leads to strength losses usually quantified by extracting the yarn out of the fabric and measuring the tenacity-according to the standard procedure known in the art. The following table 4 shows that the NPPTY product is leading to a significant advantage since in a heavy fabric construction (typically 12 ends per cm) the strength loss is reduced by half (7 vs. 14%). The ballistic performance ($V_{50}$: see test procedure) is also improved by 8% at the greige fabric level and 5 to 8% at the finished level (meaning after final fabric treatment).

In the case of light weight fabric, typically 8 ends per cm, the ballistic performances is also increased by 4.5% at the greige fabric level.

TABLE 4

Strength Conversion and Ballistic Performance

| Fabric Grade | Strength loss NPPTY | Strength loss Comp. | Percentage improvement in Ballistic Performance $V_{50}$ of NPPTY versus Comp. |
|---|---|---|---|
| HEAVY FABRIC of the state of the art: (commercially available) | | | |
| 1. Greige | 7% | 14% | |
| 2. Ballistic Perform. (Greige fabric) | | | +8% |
| 3. Ballistic Perform. (finished fabric) | | | +5-8% |
| LIGHT FABRIC of the state of the art (commercially available) | | | |
| 1. Greige | 0-2% | 0-2% | |
| 2. Ballistic Perform. (Greige fabric) | | | +4-5% |

Processability as a reinforcing element

Knitting processability evaluation was carried out under the following conditions: ELHA Circular Knitting Machine (Model RRU), test duration 4 hours, machine speed 670 RPM, knitting speed 15 m/min; knitting construction 3 stitches/cm.

TABLE 5

End-Use-Performance of different yarn Type

| | Comp. 0 T/m | Comp. TM | NPPTY process (a), (b) 0 T/m | NPPTY process (c) 0 T/m |
|---|---|---|---|---|
| Fibrillation | high | none | none | none |
| Knit Design | not uniform | uniform | uniform | uniform |
| Deposit | build-up deposit | slight deposit | no deposit | no deposit |
| Coverage Factor | not uniform | low | optimum | optimum |

According to the results given in Table 5, an optimum productivity levels and maximum value in use could be obtained using NPPTY reinforcing materials vs Comp. The state of the art product is used twisted. Table 5 clearly shows the advantage related to the possibility of avoiding the twisting operation by using the NPP-treated fiber as a reinforcing element.

Hoses Performance

Fatigue trials on hoses, made of specially NPP treated yarn, were carried out to the Ford specification with pressures of 1-3.5 bar at 0.5 Hz according to the most severe trapezoid waveform.

With standard twisted yarn (Comp. TM), 50 000 cycles to failure is generally obtained and sufficient to pass the test. A result of 75 000 cycles has been obtained for the five samples containing NPP process (a), (b) or (c) treated yarns. This shows a significant superiority of the NPP treated yarns in terms of fatigue resistance.

All hoses have been made under processing conditions described before.

Efficiency conversion of NPP treated Yarn in cord structures

Compared to commercially available aramid based construction up to 30% better strength efficiency conversion was obtained by using NPP treated yarn for cord construction. If a cord is made of several yarns, the strength of the cord theoretically should be equal to the strength of each yarn, multiplied by the number of yarns, which is never the case in practice. However, NPP helps to overcome this problem.

In a laboratory test the strength of a parallel construction made of three commercial 1100 dtex (1000 filaments) aramid yarns with a final twisting of 140 T/m (twists per meter) was determined to be 524 N. This was compared to a parallel cord construction made of three 1100 dtex yarns which were treated with NPP (0.8% by weight finish level). The finally obtained strength of a yarn with a twist level of 140 T/m was 592 N which corresponds to a increase. In a production test the strength of the NPP-treated yarn was even 30% higher, compared to a commercial yarn.

This is another result which confirms the superiority of the NPP treated fibers according to the invention in terms of efficiency conversion of the potential strength of the fiber.

I claim:

1. Highly processable aromatic polyamide fibers of high modulus, improved surface frictional properties, improved scourability, low abrasion depositing, low fibrillation and improved longterm antistatic properties having a coating of a lubricant, an emulsifying system, an antistatic agent, and other components, derived from a surface treatment agent which consists of (a) 30 to 70% by weight of a low viscosity esteroil lubricant, consisting of an ester, composed of i) an alcohol component which is a branched, primary or secondary, saturated monohydric alcohol of the general formula $$CH_3-(CH_2)_h-\overset{\overset{R^1}{|}}{(CH)_k}-(CH_2)_l-\overset{\overset{R^2}{|}}{CH}-(CH_2)_m-OH$$

wherein $R^1$ represents $C_1$-$C_{16}$-alkyl, $R^2$ represents H, $C_1$-$C_{16}$-alky, if k=1, and $R^2$ represents $C_1$-$C_{16}$-alkyl if k=0, h=0-5 k=0 or 1 l=0-4 m=0-16 and wherein the total number of carbon atoms is below 25, and, ii) a carboxylic acid component which is an unsaturated fatty acid of the general formula $$R^3-COOH$$

wherein $R^3$ represents $C_4$-$C_{19}$-alkatrienyl, phenyl, naphthyl, 2-phenyl-ethenyl, or which is an unsaturated dicarboxylic acid of the general formula $$HOOC-(CH=CH)_n-COOH$$

wherein n=1 or 2 and said ester has a solidification point of below +5° C., kinematic viscosity of below 70 $mm^2$/sec, (at 20° C.) and an iodine value between 30 and 140, b) 20 to 50% by weight of an emulsifying system which consists of unsaturated ethoxylated fatty acids and/or unsaturated ethoxylated fatty alcohols and/or ethoxylated alkylamines of the general formula $$R^4—X—(EO)_p(PO)_q—OH$$

wherein $R^4$ represents $C_5$-$C_{20}$-alkenyl, phenyl, naphthyl, or $C_8$- or $C_9$-alkylphenyl, X represents —COO—, —NH— or —O—, EO represents ethylene oxide units, PO represents propylene oxide units, p=2 to 15 and q=0 to 10, c) 5 to 15% by weight of an antistatic agent, consisting of alkali salts of $C_4$-$C_{12}$-alkyl sulfonates or $C_4$-$C_{12}$-alkyl phosphates, d) 0.2 to 2% by weight of a corrosion-inhibitor and e) optionally additives and whereby the amount of said coating on said fiber is between 0.05 and 2.0% by weight.

2. Fibers according to claim 1, characterized in that said alcohol component (i) of (a) is selected from the group consisting of 2-methyl,1-propanol, 2-butanol, 2-pentanol, 2-methyl-1-butanol, 3-methyl-1-butanol, 3-methyl-2-butanol, 2-methyl-1-pentanol, 4-methyl-1-pentanol, 4-methyl-2-pentanol, 3-heptanol, 2-octanol, 2-ethyl-1-hexanol, 3,5-dimethyl- 1-hexanol, 5-nonanol, 2-6-dimethyl-4-heptanol, iso-hexadecyl-alcohol, and iso-tridecyl alcohol.

3. Fibers according to claim 1, characterized in that said carboxylic acid component (ii) of (a) is selected from the group consistinq of lauroleic acid, myristoleic acid, palmitoleic acid, oleic acid, linoleic acid, linolenic acid, fumaric acid, maleic acid, cinnamic acid, naphthaline carboxylic acid,and benzoic acid.

4. Fibers according to claim 1, characterized in that said emulsifying system comprises octylphenolethoxylates (5-15 moles EO) and/or nonylphenolethoxylates (5-15 moles EO) and/or ethoxylated lauroleic acid, myristoleic acid, palmitoleic acid, gadoleic acid, erucic acid or ricinoleic acid, preferably oleic acid (3-15 moles EO) and/or tallow alcohol ethoxylate (3-10 moles EO).

5. Fibers according to claim 1, characterized in that the corrosion-inhibitor is selected from the group consisting of a diethanolamine salt of $C_4$- to $C_{12}$-alkyl phosphate mono- or diester, and an amine salt of a fatty acid or banzoic acid.

6. Fibers according to claim 1, characterized in that the optional additives comprise crosslinking agents and/or UV absorbers and/or pigments and/or antioxidants and/or fungicides and/or bacteriocides and/or biocides.

7. Fibers according to claim 1 characterized in that said surface treatment agent consists essentially of 50 to 60% by weight of (a), 25 to 40% by weight of (b), 5 to 10% by weight of (c), 0.3 to 1% by weight of (d) and optionally additives (e).

8. Fibers according to claim 1, characterized in that said surface treatment agent is further characterized by viscosity of lower than 120 $mm^2$/sec (at 20° C.), a weight-loss of lower than 25% after 2 h at 200° C., a surface tension of a 1% emulsion of lower than 35 mN/m at 20° C.

9. Fibers according to claim 1, characterized in that said coating is present in an amount of 0.2 to 1.0% by weight.

10. Fibers according to claim 1, characterized by a specific breaking strength of 2.65 to 33.5 cN/dtex (3 to 38 g/den), a specific modulus of 8.83 to 2207 cN/dtex (10 to 2500 g/den), a finish on yarn level of 0.05 to 2% by weight, a fiber to metal dynamic friction coefficient on a 1100 dtex aramid yarn of lower than 0.55 at 200 m/min, a fiber to metal boundary friction coefficient on a 1100 dtex aramid yarn of lower than 0.10 at 0.16 cm/sec, an amount of deposit due to abrasion of lower than 0.5 mg/kg of yarn, a residual finish level of lower than 25% by weight of the initial finish level after washing.

11. Fibers according to claim 1, characterized in that the repeating units of the aromatic polyamide have the general formula $$(—NH—A_1NH—CO—A_2—CO)_n$$

wherein $A_1$ and $A_2$ are the same or different and represent substituted or unsubstituted aromatic and/or polyaromatic and/or heteroaromatic rings.

12. Fibers according to claim 11, characterized in that $A_1$ and $A_2$ are independently from each other selected from the group consisting of 1,4-phenylene, 1,3-phenylene, 1,2-phenylene, 4,4'-biphenylene, 2,6-naphthylene, 1,5-naphthylene, 1,4-naphthylene, phenoxyphenyl-4,4'-diylene, phenoxyphenyl-3,4'-diylene, 2,5-pyridylene and 2,6-quinolylene and which may or may not be substituted by one or more substituents comprising halogen, $C_1$-$C_4$-alkyl, phenyl, carboalkoxyl, $C_1$-$C_4$-alkoxyl, acyloxy, nitro, dialkylamine, thioalkyl, carboxyl and sulfonyl and in which the amide-group may also be selected from the group consisting of carbonylhydrazide-, azo- and azoxy-.

13. Fibers according to claim 11, characterized in that the aromatic polyamide is a copolyamide in which preferably at least 80% by mole of the total $A_1$ and $A_2$ are 1,4-phenylene and phenoxyphenyl-3,4'-diylene which may or may not be substituted and the content of phenoxyphenyl-3,4'-diylene is 10% to 40% by mole.

14. Fibers according to claim 1, characterized in that the polyamide fibers consist of poly-m-phenyleneisophthalamide.

15. Fibers according to claim 1, characterized in that the polyamide fibers consist of poly-p-phenyleneterephthalamide.

16. Fibers according to claim 1, characterized in that said polyamide fibers contain optionally units which are derived from 3- or 4-aminobenzoic acid.

17. Fibers according to claim 1, characterized in that the repeating units of the aromatic polyamide have the general formula $$(—NH—Ar_1—X—Ar_2—NH—CO—Ar_1—X—Ar_2—CO—)_n$$

in which

X represents O, S, $SO_2$, NR, $N_2$, $CR_2$, CO

R represents H, $C_1$-$C_4$-alkyl and $Ar_1$ and $Ar_2$ which may be same or different are selected from the group consisting of 1,2-phenylene, 1,3-phenylene and 1,4-phenylene and in which at least one hydrogen atom may be substituted with halogen and/or $C_1$-$C_4$-alkyl.

18. Bullet and fragment resistant apparel comprising fibers according to claim 1.

* * * * *